US005720274A

United States Patent [19]

Brunner et al.

[11] Patent Number: 5,720,274

[45] Date of Patent: Feb. 24, 1998

[54] LOW-NOISE VAPOR EXHAUST HOOD

[75] Inventors: Dieter Brunner; Joachim Damrath, both of Gaggenau; Martin Kornberger, Baden-Baden, all of Germany

[73] Assignee: Gaggenau-Werke Haus-und Lufttechnik GmbH, Germany

[21] Appl. No.: 566,845

[22] Filed: Dec. 4, 1995

[30] Foreign Application Priority Data

Dec. 5, 1994 [DE] Germany ..... 44 43 176.7

[51] Int. Cl.[6] ..... F24C 15/20

[52] U.S. Cl. ..... 126/299 D; 126/299 R; 454/906

[58] Field of Search ..... 126/299 R, 299 D; 415/119; 417/312; 454/906

[56] References Cited

U.S. PATENT DOCUMENTS

| | | | |
|---|---|---|---|
| 2,056,517 | 10/1936 | Guthrie | 415/119 |
| 2,086,112 | 7/1937 | Atkins | 454/906 X |
| 2,415,621 | 2/1947 | Arnhym | 415/119 X |
| 3,156,233 | 11/1964 | O'Connell | 415/119 X |
| 3,688,867 | 9/1972 | Antonetti et al. | 417/312 X |
| 3,789,954 | 2/1974 | Raleigh | 417/312 X |
| 4,174,020 | 11/1979 | Challis | 415/119 X |
| 5,042,458 | 8/1991 | Spencer et al. | 126/299 D |

FOREIGN PATENT DOCUMENTS

| | | | |
|---|---|---|---|
| 0 083 704 | 11/1982 | European Pat. Off. . | |
| 2660990 | 10/1991 | France | 454/906 |
| 69 00 973 | 5/1969 | Germany . | |
| 1 503 610 | 4/1970 | Germany . | |
| 78 11 284 | 4/1978 | Germany . | |
| 1018084 | 1/1966 | United Kingdom . | |

*Primary Examiner*—Carl D. Price
*Attorney, Agent, or Firm*—Baker & Daniels

[57] ABSTRACT

The invention relates to a vapor exhaust hood with a housing which features at least one intake opening equipped at a minimum with one filter, and features at least one outlet opening, and the inside surfaces of which are in part lined with a sound-deadening material, with a fan arranged in the housing. Arranged in the housing, at least opposite each inlet opening of the fan, is sound-absorbing material which from the opposite inlet opening is spaced at least the radius of the fan wheel. The sound-absorbing material has a surface which in size corresponds at least to a circular surface whose radius matches that of the fan wheel. Further measures for noise reduction consist in the arrangement of a vane in the area of the outlet opening, in the application of sound-deadening and/or sound-damping material as well as in the elastic mounting of fan and/or fan motor. The invention thus creates a vapor exhaust hood in which, for one, the number of noise generators is reduced and, for another, inevitable noise is damped and deadened.

20 Claims, 2 Drawing Sheets

LOW-NOISE VAPOR EXHAUST HOOD

BACKGROUND OF THE INVENTION

1. Field of the Invention

Figure 1:
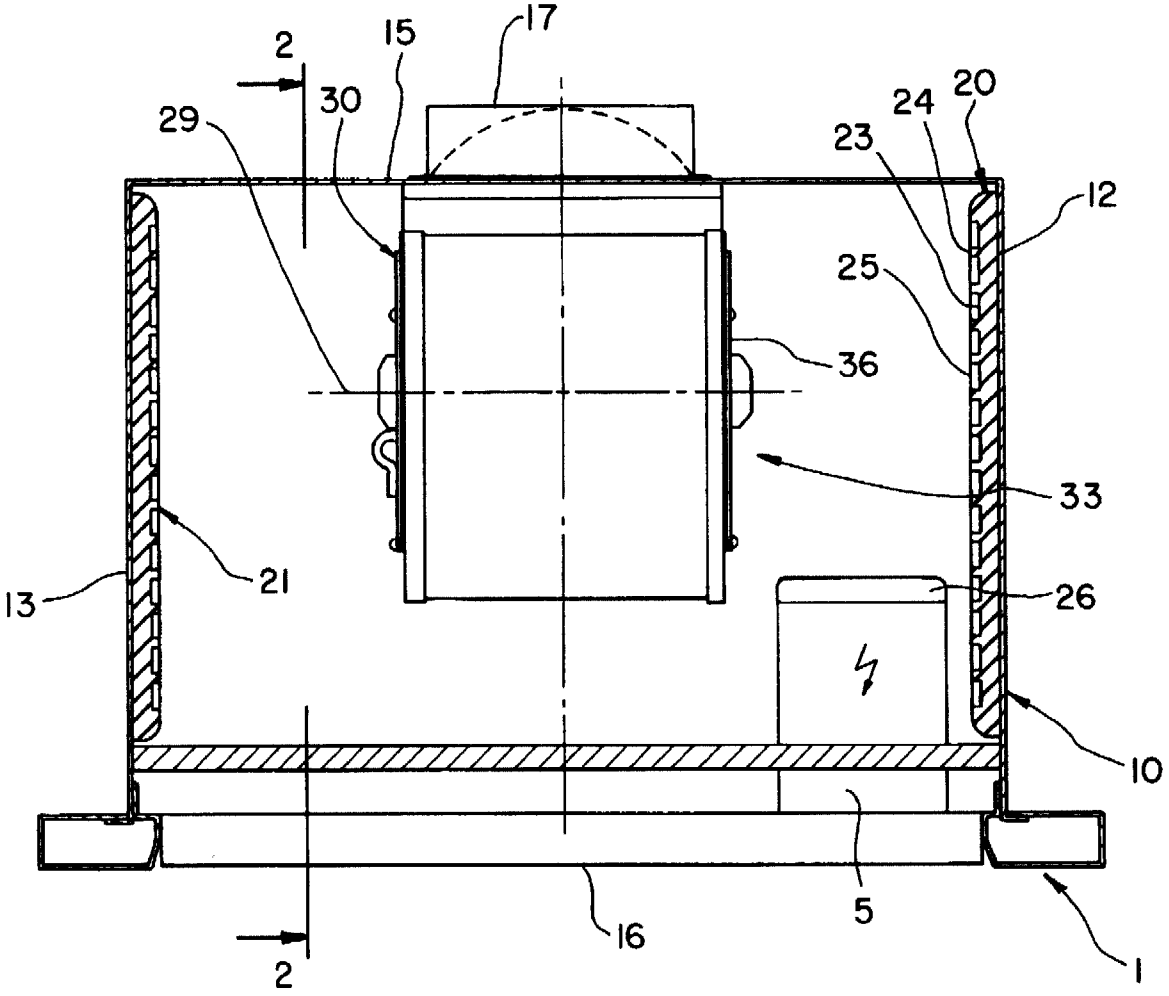

The invention relates to a vapor exhaust hood with a housing that features at least one intake opening which at a minimum is equipped with one filter, and features a vent opening whose inside surfaces are at least in part equipped with a sound-deadening material; arranged in the housing is a fan.

2. Description of the Related Art

A vapor exhaust hood of that type is known from the document GM 69 00 973. The vapor exhaust hood has a shallow, square housing which in the front area slopes toward the operator. Contained in the lower area of the housing is a filter space which downward is bounded by a filter and upward by a partition. The partition has a central hole on which borders a low-silhouette radial fan for one-sided intake. Its fan wheel rotating about a vertical axis, the radial fan has its intake nozzle directly opposite the filter. The fan housing represents the entire upper part of the vapor exhaust hood. The fan fitted in it forces the filtered air either back in the immediate surroundings or into an exhaust duct. The fan housing is provided with a sound-absorbing coating, which contributes substantially to deadening the fan noise.

Known also, from DE 78 11 284 U1, EP 0 083 704 A1 and DE-OS 1,503,610, are comparable, low-silhouette vapor exhaust hoods with radial fans which possess very large radii and narrow blades. The venting fan duct in each object is formed of sound-absorbing material. The material replaces completely the known, thin-walled fan ducts made of plastic or metal.

Known, furthermore, from GB-PS 1,018,084, is a ventilator system for fresh air delivery and air circulation. The ventilator system has a square housing which is divided in an upper and a lower part. The lower part features several ducts for air handling. The upper part comprises a dual fan fitted in a separate intake housing. The dual fan consists of two radial fans between which the motor driving them is located. The air intake of the radial fans takes place sideways, and the air is blown into the bottom part of the housing. All of the air-handling ducts located outside the intake housing are lined with polyurethane foam for sound absorption. In the intake housing, only the wall opposite the intake filter is coated with polyurethane foam. Wall and intake filter are situated parallel to the axes of fan and motor. Located opposite the intake openings of the radial fan housing is either the motor or the intake housing end walls, which are made of sheet metal.

Vapor exhaust hoods feature generally fans which, while small in overall size, must handle large exhaust flow volumes. Consequently, fan speeds up to 2900 RPM are required to achieve a large air handling capacity. At such high RPM, already minor manufacturing defects and contamination on the fan wheel lead to imbalances and unintended aerodynamic forces. Besides the 50-Hz hum of the electrical drive motors customarily used, mechanical vibrations occur which are transmitted directly from the fan housing to the housing of the vapor exhaust hood. There, said vibrations stimulate the thin-walled housing panels partly to natural oscillations. Created in the most unfavorable case are resonant phenomena, both with the natural frequencies of the housing panels and also with the air volume enclosed in the housing, resulting in an additional amplification of the vibrations. The vibrating panels radiate sound energy which is audibly sensed as airborne sound.

Airborne sound is emitted even more so by the rotating fan wheel. Depending on the fan type used, the radiated airborne sound has a complex frequency spectrum, which is composed of a wide-band flow noise and RPM-dependent harmonic components. The amplitudes of the noise, according to experience, are the greatest in the area of the fan wheel blades, since the greatest velocity gradients and, thus, turbulent pressure fluctuations occur here. Especially with low-silhouette vapor exhaust hoods, the so-called fluidics noise of the generally heavily turbulent duct and housing flow superimposes itself additionally upon said noise.

SUMMARY OF THE INVENTION

Therefore, the objective underlying the invention is to provide a vapor exhaust hood equipped with a fan, in which hood, for one, the number of noise generators is reduced and, for another, inevitable noise is damped and deadened. The material for sound damping, or sound deadening, should allow easy installation and cleaning. Also, the disadvantages known from the prior art should be avoided.

The objective is accomplished with a vapor exhaust hood where, as a minimum, sound-absorbing material is arranged opposite each inlet opening of the fan in the housing, which material is spaced from the opposite intake opening at least one-half the radius of the fan wheel. The sound-absorbing material opposite the individual inlet opening has a surface whose size matches at least a circular surface with a radius matching that of the fan wheel.

With a vapor exhaust hood of such design, the airborne sound emitting from the inlet opening impinges directly on a sound absorber, which additionally is arranged relatively far removed from the inlet opening. Reduced thereby, for one, is the noise caused by the blades, for exactly the higher-frequency noise shares of the air turbulences in the blades impinge directly on the sound absorber, due to their directional effect. With the filter and an—as the case may be—installed active filter not being arranged opposite the inlet opening, a direct sound radiation from the filter is not possible.

On the other hand, the spacious design of the intake chamber guarantees a nearly nonturbulent flow to the inlet opening of the fan, thereby avoiding the fluidics noise of the intake.

The area center of gravity of the sound absorber surface is situated preferably on the imaginary center line of the intake flow formed by the inlet opening. With a radial fan, for example, this center line coincides with the fan axis. This arrangement of the sound-absorbing material guarantees that at least the airborne sound emitting centrally from the inlet opening impinges directly on the sound absorber. With the surface of the sound-absorbing material additionally being, at least in the zone around the center line, approximately parallel to the cross-sectional surface of the inlet opening, or perpendicular to the center line of the intake flow in the area of the inlet opening, the not absorbed airborne sound is reflected back nearly uniformly and, as the case may be, absorbed by an opposite sound deadening layer.

The sound absorber, among others with larger absorber surfaces, may for an increased sound-absorbing effect also be arranged spherically curved in the housing of the vapor exhaust hood, for instance at least in some areas, provided the conditions of intake will not deteriorate thereby. Irrespective of the spatial curvature of the surface, the total area of the sound absorber also may correspond at least to the sum of the imaginary semispheric surfaces above the intake openings, the radius of the respective semispheric surface being identical with the radius of the fan wheel. By way of example, the absorber surface in a double-flow radial fan has thus the size of a spherical surface with the diameter of the fan wheel. Part of the absorber surface can be extended also to the front side, that is, the front oriented toward the operator.

When using an extensively square housing for the vapor exhaust hood, the shortest housing edge should not fall short of one-half the length of the next larger edge. With this design specification, preference goes to a cubic housing as compared to a shallow housing of same volume. A more cubic housing, for one, has the advantage of a non-turbulent influx taking place without any deflections and, for another, of more space for a low-noise, large radial fan. Also, its outer housing surfaces are smaller than in the ease of a shallow housing of equal volume. Consequently, a smaller housing inside surface should be lined with a sound absorber.

For lining, for example, a sound-absorbing material is used that consists of an open-pore foam material core which on all sides is provided with a sealed i.e., closed membrane. The membrane is a foil permeable to sound, for example of plastic, whose wall thickness is maximally 70 μm. Its tear resistance and tensile strength are such that a usual mechanical cleaning will not damage the foil. Neither will its sound permeability be altered by the effect of commercial rinsing solutions. The foil lining of the open-pore foam material core, which—as the case may be—can be replaced also by mineral wool, precludes in the sound absorber a lasting contamination and grease accumulation, due to the convenient cleaning options. Consequently, regular cleaning helps retain the effectiveness of the sound damping and avoid increased risk of fire due to grease accumulation in the foam material absorber. Besides, the smooth membrane surface reduces the flow resistance to the intake flow within the vapor exhaust hood.

To smooth the surface of the foam material core, thermal cleaning is an option. With this method, also the edge areas of the sound absorber can be sealed. The foam material core may at least on the side facing the sound generator feature additionally a structure with individual bosses on which the enveloping membrane bears. The bosses, for example, may be individual knops in the form of small semispheres, pyramids, truncated pyramids or truncated cones, cylinders or similar that are uniformly spaced. Conceivable is also a structure of relief wavy lines or of a lattice, or lattice parts. With these structures, cavities form between the membrane and the surface of the foam material core. The structures form spacers in relation to the global foam material surface. Bearing only partially, the membrane possesses an improved flexibility, thereby increasing the efficacy of the absorber. The cavities produce a greater coefficient of absorption, particularly for lower frequencies, according to the principle of a relaxation sound damper, or Helmholtz resonator.

Irrespective of the sound-absorbing coating of several housing inside surfaces, the outside surfaces of the fan housing feature at least partly a coating which dampens structural sound transmission. Such coating consists of an elastic cover in which small bodies of compound are incorporated. Conceivable also are firmly adhering coatings with alternately large and small film thickness. These coatings reduce vibrations of the relatively thin panels of the fan housing. Also, the airborne sound impinging on the fan housing is partly absorbed by the elastic coating.

Additionally, also the inside surfaces of the fan housing may be lined, at least partly, with a material absorbing airborne sound. This is advantageous, among others, in the spiraling housings of the radial fans and cross-flow fans in the outlet area, since part of the airborne sound is absorbed directly in the vicinity of the blades, and, thus, is radiated in the exhaust shaft only at a reduced rate.

To facilitate maintenance and cleaning of the vapor exhaust hood, at least the sound-absorbing material is arranged detachably on the respective housing and fan parts. Fastening the mat-shaped sound absorbers is provided for, as needed, not only in the edge area, but also within the surfaces. The easy removal of the absorbers allows a non-problematic, thorough cleaning and improved service access to the fan.

A further measure for noise reduction relates to the transition from the fan housing to the exhaust opening of the vapor exhaust hood. Said opening often has a circular cross section so as to facilitate connection to a cylindrical exhaust duct. When using radial fans, their rectangular outlet opening needs to be adapted to the bordering cylindrical exhaust shaft, or to an appropriate cylindrical duct section. When both cross sections have approximately the same area, a vane is arranged in the transition area between the two cross sections, at least one-sidedly. Serving as a half-side diffusor, the vane extends—beginning at the outlet opening—into the channel section at an opening angle above 8°. The unsteady transition from the rectangular cross section of the fan housing to the cylindrical exhaust connection piece is eased thereby, and the losses due to the Kármán vortex street and or aperiodic flow separations occurring there otherwise are reduced, or avoided. The vane reduces the flow resistance in the transitional area, whereby—for one—the discharge velocity increases and, for another, the exhaust type resonances caused by periodic vortexes are reduced considerably. Consequently, the installation of the vane creates less noise.

Additional options for reducing structurally transmitted sound are mounting the fan housing elastically in the housing of the vapor exhaust hood or on a suspension device fitted in it. To that end, e.g., rubber elements may be arranged in the area of the parting line between the two housings. Further details of the invention devolve from the following description of a schematically illustrated embodiment:

FIG. 1: Vapor exhaust hood with a double-flow radial fan in longitudinal and lateral section.

Figure 2:
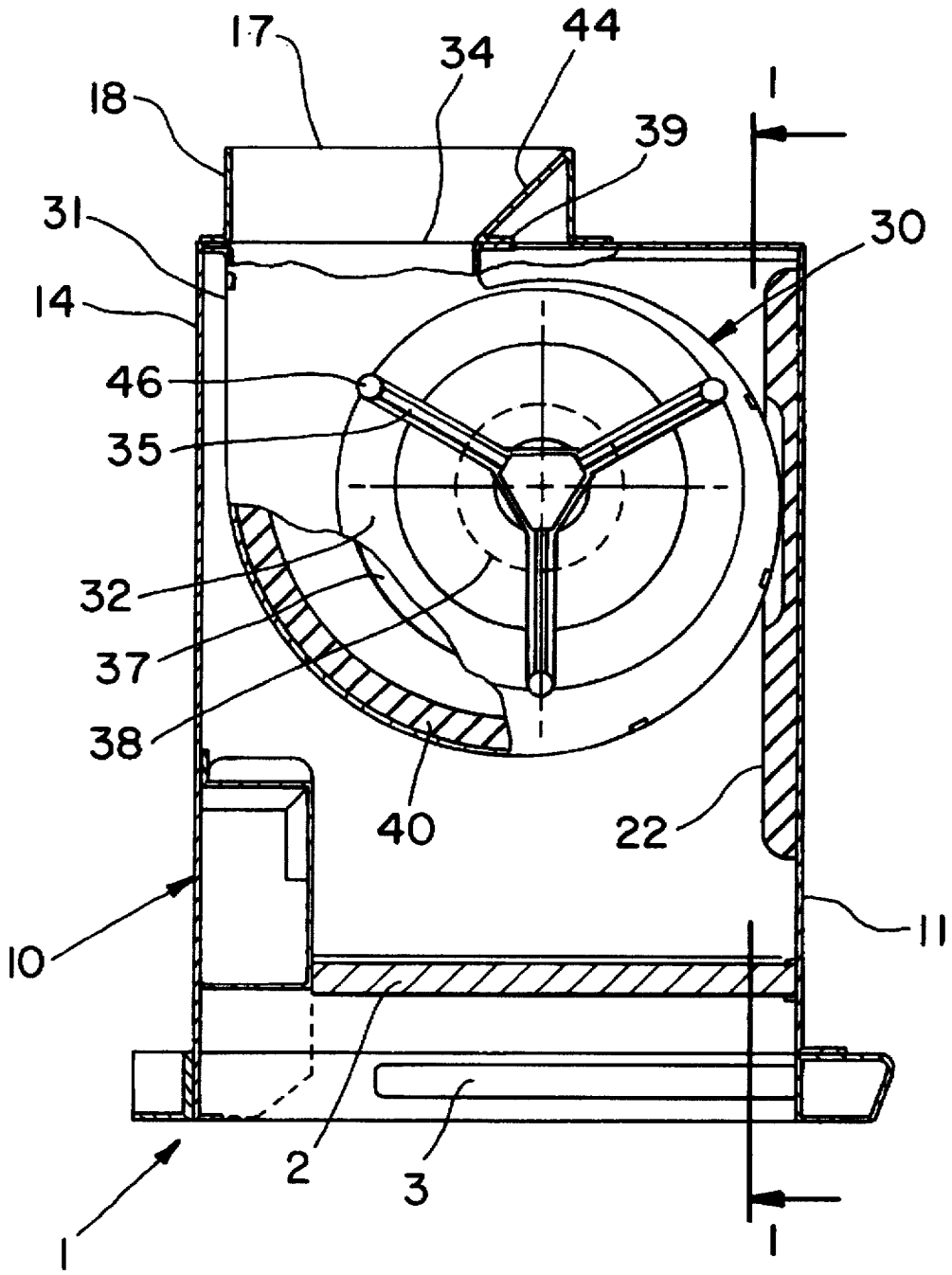

FIG. 2: Vapor exhaust hood with a double-flow radial fan in lateral section.

DESCRIPTION OF THE PRESENT INVENTION

The vapor exhaust hood 1 illustrated in FIG. 1 and FIG. 2 has a square housing (10) formed by a front wall (11), two side walls (12, 13), a rear wall (14) and a cover (15). Housing (10) is bounded, downward, by a metallic grease filter (2). Arranged beneath grease filter (2) is a slide-out vapor screen (3).

A dual-flow radial fan (30) is fitted in the housing (10). Radial fan (30) is comprised of a fan wheel (37) powered by an electric motor and of a spiral housing (31) for channeling the fresh air and exhaust air flows. Spiral housing (31) is fitted by way of flange (39) on cover (15) of vapor exhaust hood housing (10). As the case may be, an elastic ring that dampens structural sound transmission and also has a sealing effect is arranged between flange (39) and cover (15).

Fan wheel (37) with integrated electric motor (38) is mounted, via supports (35, 36) in the area of the inlet openings (32, 33) on both end faces of spiral housings (31). The two spider supports (35, 36) are mounted elastically, through the intermediary of robber dampers (46), on the end faces of radial housing (31).

The rectangular outlet opening (34) of spiral housing (31) empties in the cylindrical exhaust connector (18) with exhaust opening (17). Exhaust connector (18) here is part of cover (15). The center line of outlet opening (34) has relative to the center line of exhaust connector (18) a parallel offset toward rear wall (14). Consequently, exhaust connector (18) protrudes toward front wall (11) beyond outlet opening (34). To avoid at that point a strong formation of air vortexes, a vane (44) bridges the connection area.

Sound absorbers (20, 21) are arranged on side walls (12, 13) of housing (10), opposite inlet openings (32, 33) the spacing between inlet openings (32, 33) and side walls (12, 13) surmounts one-half the diameter of fan wheel (37). Sound absorbers (20, 21) consist of open-pore foam material core (23) circumfitted with a membrane (25) that is permeable to sound and 40 μm thick. Beneath membrane (25), foam material core (23) is structured on its side facing the fan (30). Individual knops (24) protrude out of the global surface, forming a cavity between foam material core (23) and membrane (25).

In addition to on the side walls, sound absorbers (22) and (26) are arranged here also on the front wall and on the housing of the fan control (5). All sound absorbers (20–22, 26) are affixed to the respective housing part with double-stick tape. Furthermore, a sound absorber (40) is arranged also in spiral housing (31). Adhering firmly, it is situated opposite the blades of fan wheel (37).

We claim:

1. A vapor exhaust hood comprising:

a vapor hood housing defining an intake chamber and having an intake opening;

a filter element disposed to filter air entering said intake chamber through said intake opening;

a fan assembly disposed within said intake chamber, said fan assembly including a fan wheel having a radius, a fan housing defining first and second inlet openings, and an outlet opening through which air is ventable from said vapor hood housing;

a first sound absorbing material layer disposed on said vapor hood housing within said intake chamber and having a first surface facing said first inlet opening, said first surface spaced from said first inlet opening by a distance greater than or equal to one-half the radius of said fan wheel, said first layer covering a first surface area of said vapor hood housing greater than or equal to a circular area defined by a circle having a radius equivalent to the radius of said fan wheel;

a second sound absorbing material layer disposed on said vapor hood housing within said intake chamber and having a second surface facing said second inlet opening, said second surface spaced from said second inlet opening by a distance greater than or equal to one-half the radius of said fan wheel, said second layer covering a second surface area of said vapor hood housing greater than or equal to said circular area; and a first closed membrane and a second closed membrane respectively covering said first surface and said second surface.

2. The vapor exhaust hood of claim 1 wherein said first inlet opening defines a first centerline extending perpendicular to said first inlet opening and said first surface has a first areal center of gravity positioned on said first centerline; and said second inlet opening defines a second centerline extending perpendicular to said second inlet opening and said second surface has a second areal center of gravity positioned on said second centerline.

3. The vapor exhaust hood of claim 2 wherein said first surface is disposed substantially perpendicular to said first centerline in a first zone surrounding said first centerline; and said second surface is disposed substantially perpendicular to said second centerline in a second zone surrounding said second centerline.

4. The vapor exhaust hood of claim 2 wherein said first and second sound absorbing materials each comprise an open-pore foam material core having an outer surface completely sealed by said first and second membranes respectively.

5. The vapor exhaust hood of claim 2 wherein said first and second sound absorbing material layers are detachably secured to said vapor hood housing.

6. The vapor exhaust hood of claim 1 wherein said first inlet opening defines a first centerline extending perpendicular to said first inlet opening and said first surface is disposed substantially perpendicular to said first centerline in a first zone surrounding said first centerline; and said second inlet opening defines a second centerline extending perpendicular to said second inlet opening and said second surface is disposed substantially perpendicular to said second centerline in a second zone surrounding said second centerline.

7. The vapor exhaust hood of claim 6 wherein said fast and second sound absorbing materials each comprise an open-pore foam material core having an outer surface completely sealed by said first and second membranes respectively.

8. The vapor exhaust hood of claim 6 wherein said first and second sound absorbing material layers are detachably secured to said vapor hood housing.

9. The vapor exhaust hood of claim 1 wherein the vapor hood housing is substantially square and has a shortest edge with a first length and a larger edge with a second length wherein said first length is greater than one-half of said second length.

10. The vapor exhaust hood of claim 9 wherein said first and second sound absorbing material layers are detachably secured to said vapor hood housing.

11. The vapor exhaust hood of claim 1 wherein said filter element defines a filter surface area of said intake chamber and said first sound absorbing material layer is disposed on a first sidewall, said first sidewall having a sidewall surface area which is greater than or equal to two-thirds said filter surface area.

12. The vapor exhaust hood of claim 11 wherein said first and second sound absorbing material layers are detachably secured to said vapor hood housing.

13. The vapor exhaust hood of claim 1 wherein said first and second sound absorbing materials each comprise an open-pore foam material core having an outer surface completely sealed by said first and second membranes respectively.

14. The vapor exhaust hood of claim 13 wherein said foam material cores each comprise a plurality of individual bosses respectively supporting said first and second membranes defining said first and second surfaces.

15. The vapor exhaust hood of claim 1 further comprising a sound deadening coating on an outside surface of said fan housing.

16. The vapor exhaust hood of claim 15 wherein said fan assembly further comprises sound-absorbing material disposed on an interior surface of said fan housing.

17. The vapor exhaust hood of claim 1 further comprising a sound deadening coating on an interior surface of said fan housing.

18. The vapor exhaust hood of claim 1 wherein said first and second sound absorbing material layers are detachably secured to said vapor hood housing.

19. The vapor exhaust hood of claim 1 wherein said outlet opening is rectangular and extends into a cylindrical duct section, said rectangular outlet opening and the cylindrical duct section having approximately equal cross-sectional areas, and said outlet opening further comprises a vane originating at a side of said outlet opening and extending into the cylindrical duct section at an opening angle greater than 8°.

20. The vapor exhaust hood of claim 1 wherein said fan housing is elastically mounted within said vapor hood housing.

* * * * *